US008338345B2

(12) United States Patent
Kawasaki et al.

(10) Patent No.: US 8,338,345 B2
(45) Date of Patent: Dec. 25, 2012

(54) WATER-BASED METALWORKING FLUID

(75) Inventors: Hiroshi Kawasaki, Ichihara (JP); Fumiaki Takagi, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 94 days.

(21) Appl. No.: 12/671,383

(22) PCT Filed: Jul. 15, 2008

(86) PCT No.: PCT/JP2008/062726

§ 371 (c)(1),
(2), (4) Date: Jan. 29, 2010

(87) PCT Pub. No.: WO2009/016954

PCT Pub. Date: Feb. 5, 2009

(65) Prior Publication Data

US 2010/0187480 A1 Jul. 29, 2010

(30) Foreign Application Priority Data

Jul. 30, 2007 (JP) ..... 2007-197816

(51) Int. Cl.

| | |
|---|---|
| ***C10L 1/22*** | (2006.01) |
| ***C07C 317/22*** | (2006.01) |
| ***C07C 329/16*** | (2006.01) |
| ***C10M 159/18*** | (2006.01) |
| ***C10M 133/06*** | (2006.01) |
| ***C10M 133/08*** | (2006.01) |
| ***B01D 19/04*** | (2006.01) |
| ***C08F 8/34*** | (2006.01) |
| ***C09K 15/24*** | (2006.01) |
| ***C09K 3/00*** | (2006.01) |
| ***C23F 11/00*** | (2006.01) |

(52) U.S. Cl. ..... 508/562; 508/243; 508/244; 508/267; 508/545; 508/548; 508/561; 252/391; 252/392

(58) Field of Classification Search ..... 252/391, 252/392; 508/243, 244, 267, 545, 548, 561, 508/562, 583

See application file for complete search history.

(56) References Cited

U.S. PATENT DOCUMENTS

| | | | | |
|---|---|---|---|---|
| 5,840,666 | A * | 11/1998 | Yokouchi et al. | 508/291 |
| 6,908,912 | B2 * | 6/2005 | Rioux et al. | 514/188 |
| 2003/0168626 | A1 * | 9/2003 | Eastwood et al. | 252/71 |
| 2005/0158263 | A1 * | 7/2005 | Rioux et al. | 424/70.1 |
| 2008/0194439 | A1 * | 8/2008 | Kato et al. | 508/154 |
| 2009/0118151 | A1 * | 5/2009 | Sasaki et al. | 508/545 |

FOREIGN PATENT DOCUMENTS

| | | |
|---|---|---|
| JP | 2 242891 | 9/1990 |
| JP | 4 214797 | 8/1992 |
| JP | 4 292691 | 10/1992 |
| JP | 6 76590 | 9/1994 |
| JP | 2795890 | 6/1998 |
| JP | 10 251683 | 9/1998 |
| JP | 10 324888 | 12/1998 |
| JP | 11 293274 | 10/1999 |
| JP | 2000 87074 | 3/2000 |
| JP | 2002 80882 | 3/2002 |
| JP | 2002 285185 | 10/2002 |
| JP | 2002 285186 | 10/2002 |
| WO | 2006 129747 | 12/2006 |

OTHER PUBLICATIONS

"Antibacterial Agents for Metalworking fluids", The Society for Antibacterial and Antifungal Agents, pp. 31 to 32, Aug. 22, 1986 (with English translation).

* cited by examiner

*Primary Examiner* — Lorna M Douyon
*Assistant Examiner* — Tanisha Diggs
(74) *Attorney, Agent, or Firm* — Oblon, Spivak, McClelland, Maier & Neustadt, L.L.P.

(57) ABSTRACT

Water-based metalworking fluid contains: (A) alkanolamine represented by the following formula (1) and/or (B) alkanolamine represented by the following formula (2); and (C) 2-pyridylthio-1-oxide salt.

(1)

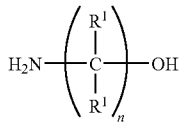

In the formula (1): each $R^1$ represents hydrogen or an alkyl group having 1 to 3 carbon atoms; n represents 2 or 3; and plural $R^1$ may be mutually the same or different on condition that not all $R^1$ represent hydrogen.

(2)

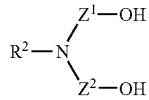

In the formula (2): $R^2$ represents an alkyl group having 1 to 10 carbon atoms; and $Z^1$ and $Z^2$ each represent an alkylene group having 2 to 8 carbon atoms.

12 Claims, No Drawings

WATER-BASED METALWORKING FLUID

This application is a 371 of PCT/JP2008/062726, filed Jul. 15, 2008.

TECHNICAL FIELD

The present invention relates to water-based metalworking fluid used in metalworking such as cutting or grinding.

BACKGROUND ART

Metalworking fluid used in metalworking is generally categorized into oil-type (oil-based) fluid and water-type (water-based) fluid, the latter of which is more frequently used because such water-based (water-soluble) fluid is excellent in cooling capabilities and infiltration capabilities and free from a risk of causing a fire. Such water-based (water-soluble) metalworking fluid, which is to be diluted with water in use, is required to have rust resistance and rot resistance. Depending on usages, such water-based (water-soluble) metalworking fluid may be required to have antifoaming capabilities, chip-settling capabilities and lubricity as well.

Conventionally, water-soluble metalworking fluid containing a component such as a mixture of an inorganic salt and alkanolamine, a mixture of an inorganic salt, alkanolamine and polyalkylene glycol or a mixture of an inorganic salt, alkanolamine and an amine salt of linear aliphatic acid has been widely used (for instance, see Patent Document 1 or 2). When such water-soluble metalworking fluid is actually used, the main component thereof is diluted to 20 to 100 times for use.

Patent Document 1: JP-B-06-76590

Patent Document 2: JP-A-2002-285186

DISCLOSURE OF THE INVENTION

Problems to Be Solved by the Invention

However, balancing between rust resistance and rot resistance has been difficult even in the water-soluble metalworking fluid disclosed in Patent Document 1 or 2, so that further improvements in water-soluble metalworking fluid are being demanded.

On the other hand, while environmental issues are attracting more and more attention, regulations on chemical substances are being tightened. In Japan, chemical substances are regulated not only under Poisonous Material Control Law, Industrial Safety and Health Law and Chemical Substances Control Law but also under Pollutant Release and Transfer Registers Law (PRTR Law) enacted in 1999. In view of carcinogenicity and chronic toxicity to specific organs of chemical substances, PRTR Law requires ejection and transfer of such chemical substances that may be harmful to human health and ecosystems to be registered so as to obviate problems related to environmental conservation. Monoethanolamine and boric acid, which are primary base materials for water-based metalworking fluid, have been designated as the first-class designated chemical substances. In addition, some users of water-based metalworking fluid tend to voluntarily refrain from using secondary amine (a substance that may be converted into a carcinogenic nitroso compound in human bodies) and ethanolamines (substances to which an obligation of notification pertains under Industrial Safety and Health Law). Therefore, it is not possible to simply use chemical substances strong in rust resistance, disinfection and bacteriostasis in such water-based metalworking fluid.

An object of the present invention is to provide water-based metalworking fluid that is: excellent in rust resistance and rot resistance; more environmentally friendly; and less harmful to human bodies.

Means for Solving the Problems

In order to solve the above problem(s), the present invention provides the following water-based metalworking fluid:

[1] water-based metalworking fluid, containing: (A) alkanolamine represented by the following formula (1) and/or (B) alkanolamine represented by the following formula (2); and (C) 2-pyridylthio-1-oxide salt,

[Chemical Formula 1]

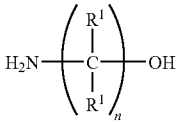

(1)

where: each $R^1$ represents hydrogen or an alkyl group having 1 to 3 carbon atoms; n represents 2 or 3; and plural $R^1$ may be mutually the same or different on condition that not all $R^1$ represent hydrogen,

[Chemical Formula 2]

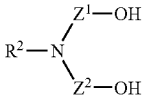

(2)

where: $R^2$ represents an alkyl group having 1 to 10 carbon atoms; and $Z^1$ and $Z^2$ each represent an alkylene group having 2 to 8 carbon atoms;

[2] the above-described water-based metalworking fluid, in which $R^2$ in the component (B) includes a cycloalkyl structure;

[3] the above-described water-based metalworking fluid, in which the component (A) is contained therein with a content of 0 to 50 mass % of the total amount of the water-based metalworking fluid, the component (B) is contained therein with a content of 0 to 50 mass % of the total amount of the water-based metalworking fluid and the component (C) is contained therein with a content of 0.01 to 5 mass % of the total amount of the water-based metalworking fluid; and

[4] water-based metalworking fluid prepared by diluting the above-described water-based metalworking fluid with water an amount of which is 5 to 200 times as much as that of the above-described water-based metalworking fluid by mass ratio.

According to the aspect(s) of the present invention, since the specific-structured alkanolamine and the specific-structured 2-pyridylthio-1-oxide salt are contained therein, the water-based metalworking fluid exhibits performances such as rust resistance and rot resistance (disinfection and bacteriostasis) that are fundamental to water-based metalworking fluid. In addition, since the water-based metalworking fluid according to the aspect(s) of the present invention contains neither chemical substances designated under PRTR Law nor secondary amine and does not generate formaldehyde, the water-based metalworking fluid provided according to the present invention is less harmful to the environment and human bodies.

BEST MODE FOR CARRYING OUT THE INVENTION

Embodiment(s) of the present invention will be described below.

A water-based metalworking fluid according to an aspect of the present invention contains: (A) alkanolamine represented by the following formula (1) and/or (B) alkanolamine represented by the following formula (2); and (C) 2-pyridylthio-1-oxide salt.

[Chemical Formula 3]

(1)

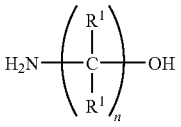

[Chemical Formula 4]

(2)

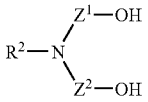

First of all, the component (A) will be described. The component (A) is used for particularly providing rust resistance to the water-based metalworking fluid. In the above formula (1), each $R^1$ represents hydrogen or an alkyl group having 1 to 3 carbon atoms, n represents 2 or 3, and plural $R^1$ may be mutually the same or different on condition that not all $R^1$ represent hydrogen. In other words, alkanolamine as the component (A) is not monoethanolamine. When n is 4 or more, solubility of the component (A) is unfavorably reduced. n is the most preferably 2. When n is 1, formaldehyde may be unfavorably easily discharged due to degradation. In addition, when any one of $R^1$ has 4 or more carbon atoms, the solubility thereof and rust resistance for iron are unfavorably deteriorated.

Examples of the component (A) are 1-amino-2-propanol, 2-amino-2-methyl-1-propanol, 1-amino-2-butanol, 2-amino-1-propanol, 3-amino-2-butanol and the like. Among the above, in view of the rust resistance for iron, 1-amino-2-propanol and 2-amino-2-methyl-1-propanol are particularly preferable.

In the present invention, the component (A) may contain single one of the above substances or plural ones of the above substances.

Next, alkanolamine as the component (B) will be described. The component (B) contributes not only to rust resistance but also to rot resistance. In the formula (2), which represents the component (B), $R^2$ represents an alkyl group having 1 to 10 carbon atoms. When $R^2$ represents hydrogen, rot resistance is unfavorably deteriorated. When $R^2$ has a non-cyclic structure, the alkyl group represented by $R^2$ preferably has 1 to 4 carbon atoms, more preferably 1 carbon atom. When $R^2$ contains 11 or more carbon atoms, solubility and rust resistance of the component (B) are unfavorably deteriorated. $Z^1$ and $Z^2$ each independently represent an alkylene group having 2 to 8 carbon atoms. When the number of the carbon atoms contained in at least either one of $Z^1$ and $Z^2$ is 1, the component (B) is degraded to generate formaldehyde, which is environmentally unfavorable. When the number of the carbon atoms contained in at least either one of $Z^1$ and $Z^2$ is 9 or more, solubility of the component (B) are unfavorably deteriorated.

Examples of the components (B) are N-methyldiethanolamine, N-ethyldiethanolamine, cyclohexyldiethanolamine, N-n-propyldiethanolamine, N-i-propyldiethanolamine, N-n-butyldiethanolamine, N-i-butyldiethanolamine, N-t-butyldiethanolamine and the like. $R^2$ preferably includes a branched alkyl structure or a cycloalkyl structure because rot resistance can be enhanced. $R^2$ is particularly preferably cyclohexyldiethanolamine.

In the present invention, the component (B) may contain single one of the above substances or plural ones of the above substances.

The component (C) contained in the water-based metalworking fluid according to the present invention is 2-pyridylthio-1-oxide salt. The component (C) provides disinfection effects.

Examples of the component (C) are 2-pyridylthio-1-oxide sodium, zinc bis(2-pyridylthio-1-oxide), bis(2-sulfidepyridine-1-olato) copper and the like. Among the above, 2-pyridylthio-1-oxide sodium is particularly preferable because the substance is effective on general bacteria and molds in a wide range even when contained therein with a low concentration.

The water-based metalworking fluid according to the present invention may be formed of the component (A) and the component (C). Alternatively, the water-based metalworking fluid may be formed of the component (B) and the component (C).

In view of handling ability, the water-based metalworking fluid according to the present invention is preferably prepared as a stock solution having a high concentration, so that the user dilutes the fluid as necessary with water to use the diluted fluid as metalworking fluid.

Solvent for the stock solution is the most preferably water, but may be mineral oil or synthetic oil.

Such mineral oil or synthetic oil used as the solvent for preparing the stock solution is not specifically limited but may be any base oil generally used for metalworking fluid. Such mineral oil or synthetic oil preferably has kinetic viscosity at 40 degrees C. in a range of 1 to 50 $mm^2/s$, more preferably in a range of 2 to 30 $mm^2/s$. When the base oil has too high kinetic viscosity, the fluid may adhere to a workpiece to be carried together with the workpiece, which may be economically unfavorable. In contrast, when the base oil has too low kinetic viscosity, mist generation may unfavorably deteriorate workability. The pour point (i.e., the index of low-temperature fluidity) of the base oil is not subject to any limitations, but preferably −10 degrees C. or less.

As the mineral oil or the synthetic oil, various kinds of oil are available. The mineral oil or the synthetic oil may be suitably selected therefrom, depending on the usage.

Examples of the mineral oil are oil fraction obtained by atmospherically distilling paraffin-based crude oil, intermediate-based crude oil or naphthene-based crude oil or by vacuum-distilling residual oil formed by atmospheric distilling, and purified oil obtained by refining the oil fraction in accordance with an ordinary method. Examples of the purified oil are solvent-refined oil, hydrogenerated refined oil, dewaxing-processed oil, white clay-processed oil and the like.

On the other hand, examples of the synthetic oil are poly-α-olefin, α-olefin copolymer, polybutene, alkylbenzene, polyolester, diacid ester, polyoxyalkylene glycol, polyoxyalkylene glycol ester, polyoxyalkylene glycol ether, silicon oil and the like. Among the above synthetic oil, poly-α-olefin and α-olefin copolymer are preferable. The base oil may contain single one or plural ones of the above oil, or may contain both the mineral oil and the synthetic oil.

The component (A) is preferably contained in the stock solution with a content of 0 to 50 mass % of the total amount of the stock solution, more preferably 10 to 45 mass %, much more preferably 20 to 40 mass %. Even when the component (A) is contained therein with a content of more than 50 mass %, rust resistance for iron is not further enhanced in accordance with the increase in the content of the component (A), which merely contributes to high cost (i.e., economically unfavorable).

The component (B) is preferably contained in the stock solution with a content of 0 to 50 mass % of the total amount of the stock solution, more preferably 10 to 45 mass %, much more preferably 20 to 40 mass %. Even when the component (B) is contained therein with a content of more than 50 mass %, rust resistance for iron is not further enhanced in accordance with the increase in the content of the component (B), which merely contributes to high cost (i.e., economically unfavorable).

The component (C) is preferably contained in the stock solution with a content of 0.01 to 5 mass % of the total amount of the stock solution, more preferably 0.05 to 2 mass %, much more preferably 0.05 to 1 mass %. When the content of the component (C) is less than 0.01 mass %, the disinfection effects of the fluid may be unfavorably deteriorated to impair rot resistance. On the other hand, when the content of the component (C) is more than 5 mass %, the component (C) may unfavorably form a complex together with metal ion to easily cause discoloration. In addition, increasing the content of the component (C) to more than 5 mass % merely contributes to high cost, which is economically unfavorable.

The water-based metalworking fluid according to the present invention particularly preferably contains all the three components of the components (A), (B) and (C) because the rust resistance and the rot resistance can be further enhanced.

The summed content of the components (A) to (C) is preferably 70 mass % or less of the total amount of the stock solution. When the summed content of the three components is more than 70 mass %, the three components are not easily dissolved in a solvent (especially water) at the time of preparing the stock solution.

When the water-based metalworking fluid according to the present invention is used, the above-described stock solution is preferably diluted with water an amount of which is 5 to 200 times as much as that of the stock solution by mass ratio. The stock solution is more preferably diluted to 10 to 100 times, much more preferably 30 to 50 times. Fluid prepared by diluting the stock solution to less than 5 times is not favorable because of its high cost. On the other hand, fluid prepared by diluting the stock solution to more than 200 times unfavorably exhibits insufficient rust resistance and rot resistance.

The water-based metalworking fluid may be blended as necessary with publicly-known various kinds of additives unless an object of the present invention is not deteriorated. Examples of the additives are aliphatic carboxylic acid, an emulsifier, an extreme pressure agent, an oil-based agent, antifoaming agent and the like.

The aliphatic carboxylic acid is added to the fluid in order to further enhance cutting capabilities, grinding capabilities and rust resistance of the fluid. An example of the aliphatic carboxylic acid is carboxylic acid having 6 to 60 carbon atoms and/or dicarboxylic acid. Specific examples of the aliphatic carboxylic acid are caproic acid, caprylic acid, nonane acid, lauric acid, stearic acid, olein acid, ricinolein acid, hydroxyfatty acid (such as recinoleic acid or 12-hydroxystearic acid), arachidic acid, behenic acid, melissic acid, isononane acid, neo-decane acid, isostearic acid, fatty acid extracted from fat and oil such as soy oil fatty acid, coconut oil fatty acid or rape-seed oil fatty acid, acid extracted from petroleum such as naphthene acid, adipic acid, sebacic acid, dodecanoic diacid, monohydroxy arachidic acid or dihydroxy arachidic acid, and synthetic fatty acid such as dimer or trimer of olein acid, recinoleic acid, ricinolein acid, 12-hydroxystearic acid. In view of antifoaming of the fluid and stability of hard water, examples of particularly preferable monocarboxylic acid are caproic acid having 8 to 10 carbon atoms, nonane acid having 8 to 10 carbon atoms and decane acid having 8 to 10 carbon atoms while examples of particularly preferable dicarboxylic acid are nonane diacid, undecanoic diacid, sebacic acid, dodecanoic diacid and the like. In view of blending effects, the carboxylic acid is preferably blended in the stock solution so that the carboxylic acid is contained with a content of approximately 0.1 to 1.5 mass % of the total amount of the final diluted fluid.

Examples of the extreme pressure agent are a sulfur-based extreme pressure agent, a phosphorus-based extreme pressure agent, an extreme pressure agent containing sulfur and metal and an extreme pressure agent containing phosphorus and metal. The extreme pressure agent may contain single one or plural ones of the above. The extreme pressure agent may be any extreme pressure agent, as long as the extreme pressure agent contains sulfur atoms and/or phosphorus atoms in its molecule and as long as the extreme pressure agent can provide load bearing effects and wear resistance. Examples of the extreme pressure agent containing sulfur in its molecule are sulfurized fat and oil, sulfurized fatty acid, ester sulfide, olefin sulfide, dihydrocarbyl polysulfide, a thiadiazole compound, an alkylthiocarbamoyl compound, a triazine compound, a thioterpene compound, a dialkylthiodipropionate compound and the like. In view of blending effects, the extreme pressure agent is preferably blended in the stock solution so that the extreme pressure agent is contained with a content of approximately 0.05 to 0.5 mass % of the total amount of the final diluted fluid.

Examples of the oil-based agent are a fatty acid compound such as fatty alcohol, fatty acid or fatty acid salt, an ester compound such as polyol ester, sorbitan ester or glyceride, an amine compound such as fatty amine and the like. In view of blending effects, the oil-based agent is preferably blended in the stock solution so that the oil-based agent is contained with a content of approximately 0.2 to 2 mass % of the total amount of the final diluted fluid.

Examples of the antifoaming agent are methyl silicone oil, fluorosilicone oil, polyacrylate and the like. In view of blending effects, the antifoaming agent is preferably blended in the stock solution so that the antifoaming agent is contained with a content of approximately 0.004 to 0.04 mass % of the total amount of the final diluted fluid.

The water-based metalworking fluid according to the present invention, which is diluted as necessary with water so that its concentration is adjusted suitably for the usage, is preferably applied in various metalworking fields such as cutting, grinding, polishing, squeezing, drawing, flatting and the like. Further, the water-based metalworking fluid according to the present invention is excellent in rust resistance for metal products and rot resistance and less harmful to the environment and human bodies.

EXAMPLES

Next, the present invention will be described in detail with reference to Examples. However, the present invention is not limited at all by the Examples.

Examples 1 to 9, Comparatives 1 to 5

Water-based metalworking fluid (stock solution) according to each of Examples 1 to 9 and Comparatives 1 to 5 was prepared by blending components shown in Table 1 or 2. After the prepared stock solution was diluted with water to a certain concentration, Examples 1 to 9 and Comparatives 1 to 5 each were evaluated in terms of the following characteristics. Evaluation results are shown in Tables 3 and 4.

(1) Rust Resistance (Based on DIN51360-02-A)

Examinations of rust resistance were conducted at room temperature for two hours on fluid prepared by diluting the stock solution with tap water to the concentration of 1.00 mass %, 1.25 mass %, 2.00 mass %, 3.33 mass %, 5.00 mass % and 10.0 mass % respectively. The minimum concentration at which a rust value had become 0 was set as limit concentration (mass %) in terms of rust resistance.

(2) Rot Resistance (Bacteriostasis)

By shaking culture (at 30 degrees C. for four weeks), Examples 1 to 9 and Comparatives 1 to 5 were evaluated in terms of bacteriostasis. Specifically, 100 ml of aqueous solution prepared by diluting the stock solution with tap water to a concentration of 3.3 mass % was inoculated with 5 ml of a bacterium A and 5 ml of bacterium B continuously every week. The bacterium A and the bacterium B are rotten solution respectively obtained from a factory site A and a factory site B in both of which water-soluble cutting fluid was actually used.

Then, the number of each bacterium was measured by Easicult method after four weeks. Specifically, using the following simple medium (manufactured by Orion, a Finnish corporation) for each bacterium, the number of each bacterium or a propagation degree of each bacterium was determined based on a predetermined reference chart.

General bacterium: Easicult TTC

Mold, yeast: Easicult M

Sulfate reducer: Easicult S

Table 5 shows evaluation items on which measurement was conducted and evaluation standards (evaluation points) relied on at the time of the evaluation. Practically, rot resistance given 10 or more evaluation points is preferable.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Prepared Composition (mass %) | 1-amino-2-propanol (Component A) | 35.40 | — | — | — | — | — | 25.40 | 25.40 | 25.40 |
| | 2-amino-2-methyl-1-propanol (Component A) | — | 35.40 | — | — | — | — | — | — | — |
| | 1-amino-2-butanol (Component A) | — | — | 35.40 | — | — | — | — | — | — |
| | N-methyldiethanolamine (Component B) | — | — | — | 35.40 | — | — | 10.00 | — | — |
| | N-ethyldiethanolamine (Component B) | — | — | — | — | 35.40 | — | — | 10.00 | — |
| | cyclohexyldiethanolamine (Component B) | — | — | — | — | — | 35.40 | — | — | 10.00 |
| | 2-pyridylthio-1-oxide sodium (Component C) | 0.10 | 0.10 | 0.10 | 0.10 | 0.10 | 0.10 | 0.10 | 0.10 | 0.10 |
| | diethanolamine | — | — | — | — | — | — | — | — | — |
| | triethanolamine | — | — | — | — | — | — | — | — | — |
| | 2-(2-aminoethoxy)ethanol | — | — | — | — | — | — | — | — | — |
| | isononane acid | 1.00 | 1.00 | 1.00 | 1.00 | 1.00 | 1.00 | 1.00 | 1.00 | 1.00 |
| | dodecanoic diacid | 9.00 | 9.00 | 9.00 | 9.00 | 9.00 | 9.00 | 9.00 | 9.00 | 9.00 |
| | C7 to C11 diacid | 1.50 | 1.50 | 1.50 | 1.50 | 1.50 | 1.50 | 1.50 | 1.50 | 1.50 |
| | nonane acid | 1.00 | 1.00 | 1.00 | 1.00 | 1.00 | 1.00 | 1.00 | 1.00 | 1.00 |
| | water | 50.00 | 50.00 | 50.00 | 50.00 | 50.00 | 50.00 | 50.00 | 50.00 | 50.00 |
| | others [1)] | 2.00 | 2.00 | 2.00 | 2.00 | 2.00 | 2.00 | 2.00 | 2.00 | 2.00 |
| | Total | 100.00 | 100.00 | 100.00 | 100.00 | 100.00 | 100.00 | 100.00 | 100.00 | 100.00 |

[1)] benzotriazole: 1 mass %, 30 mass % aqueous solution of polyethyleneimine (molecular weight of 1000): 0.3 mass %, 33 mass % aqueous solution of benzoisothiazoline: 0.2 mass %, silicone-based antifoaming agent: 0.5 mass %

TABLE 2

| | | Comparative 1 | Comparative 2 | Comparative 3 | Comparative 4 | Comparative 5 |
|---|---|---|---|---|---|---|
| Prepared Composition (mass %) | 1-amino-2-propanol (Component A) | — | — | — | — | 7.00 |
| | 2-amino-2-methyl-1-propanol (Component A) | — | — | — | — | — |
| | 1-amino-2-butanol (Component A) | — | — | — | — | — |
| | N-methyldiethanolamine (Component B) | — | — | — | 35.50 | — |

TABLE 2-continued

| | Comparative 1 | Comparative 2 | Comparative 3 | Comparative 4 | Comparative 5 |
|---|---|---|---|---|---|
| N-ethyldiethanolamine (Component B) | — | — | — | — | — |
| cyclohexyldiethanolamine (Component B) | — | — | — | — | — |
| 2-pyridylthio-1-oxide sodium (Component C) | 0.10 | 0.10 | 0.10 | — | — |
| diethanolamine | 35.40 | — | — | — | — |
| triethanolamine | — | 35.40 | — | — | 28.50 |
| 2-(2-aminoethoxy)ethanol | — | — | 35.40 | — | — |
| isononane acid | 1.00 | 1.00 | 1.00 | 1.00 | 1.00 |
| dodecanoic diacid | 9.00 | 9.00 | 9.00 | 9.00 | 9.00 |
| C7 to C11 diacid | 1.50 | 1.50 | 1.50 | 1.50 | 1.50 |
| nonane acid | 1.00 | 1.00 | 1.00 | 1.00 | 1.00 |
| water | 50.00 | 50.00 | 50.00 | 50.00 | 50.00 |
| others [1)] | 2.00 | 2.00 | 2.00 | 2.00 | 2.00 |
| Total | 100.00 | 100.00 | 100.00 | 100.00 | 100.00 |

[1)] benzotriazole: 1 mass %, 30 mass % aqueous solution of polyethyleneimine (molecular weight of 1000): 0.3 mass %, 33 mass % aqueous solution of benzoisothiazoline: 0.2 mass %, silicone-based antifoaming agent: 0.5 mass %

TABLE 3

| Evaluation Item | | Example 1 | Example 2 | Example 3 | Example 4 | Example 5 | Example 6 | Example 7 | Example 8 | Example 9 |
|---|---|---|---|---|---|---|---|---|---|---|
| Rust Resistance | Rust-resistance limit concentration (mass %) | 1.00 | 1.50 | 1.50 | 1.50 | 1.50 | 2.00 | 1.50 | 1.50 | 1.50 |
| Rot Resistance | Reduction in pH | 3 | 3 | 3 | 2 | 2 | 2 | 2 | 2 | 3 |
| | Number of general bacterium | 3 | 3 | 3 | 2 | 2 | 3 | 2 | 2 | 3 |
| | Mold | 3 | 3 | 3 | 3 | 3 | 3 | 3 | 3 | 3 |
| | Number of yeast | 3 | 3 | 3 | 3 | 3 | 3 | 3 | 3 | 3 |
| | Sulfate reducer | 3 | 3 | 2 | 1 | 1 | 1 | 2 | 2 | 3 |
| | <Evaluation Point> | 15 | 15 | 14 | 11 | 11 | 12 | 12 | 12 | 15 |

TABLE 4

| Evaluation Item | | Comparative 1 | Comparative 2 | Comparative 3 | Comparative 4 | Comparative 5 |
|---|---|---|---|---|---|---|
| Rust Resistance | Rust-resistance limit concentration (mass %) | 1.50 | 1.50 | 1.50 | 1.50 | 1.50 |
| Rot Resistance | Reduction in pH | 1 | 3 | 1 | 2 | 1 |
| | Number of general bacterium | 1 | 1 | 1 | 2 | 1 |
| | Mold | 2 | 1 | 3 | 1 | 3 |
| | Number of yeast | 2 | 1 | 0 | 1 | 1 |
| | Sulfate reducer | 0 | 0 | 1 | 0 | 1 |
| | <Evalutation Point> | 6 | 6 | 6 | 6 | 7 |

(Evaluation Standard for Rot Resistance)

TABLE 5

| | | | | | |
|---|---|---|---|---|---|
| Evaluation Item | Reduction in pH (4 weeks later) | less than 0.5 | 0.5 to 1.0 | 1.0 to 2.0 | 2.0 or more |
| | Number of general bacterium/ml (4 weeks later) | $10^2$ or less | $10^3$ to $10^5$ | $10^6$ or more | — |
| | Mold (4 weeks later) | — | slight degree | moderate to intense degree | — |
| | Number of yeast/ml (4 weeks later) | 0 | $10^1$ to $10^3$ | $10^4$ to $10^5$ | $10^6$ or more |
| | Sulfate reducer (4 weeks later) | — | slight degree | moderate to intense degree (2 weeks) | intense degree (1 week) |
| Evaluation Point | | 3 points | 2 points | 1 point | 0 point |

Evaluation Results

As is understood from Tables 3 and 4, the water-based metalworking fluid according to each of Examples 1 to 9 of the present invention is excellent in rust resistance and rot resistance, and contains no component that is harmful to human bodies. In contrast, since the water-based metalworking fluid according to each of Comparatives 1 to 5 does not contain the essential components required in the present invention, rust resistance and rot resistance are not well-balanced therein.

The invention claimed is:

1. A water-soluble metalworking fluid, consisting of water as a solvent, (A) an alkanolamine represented by formula (1):

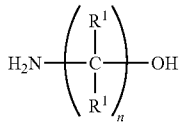

(1)

where each $R^1$ individually represents hydrogen or an alkyl group having 1 to 3 carbon atoms and n represents 2 or 3, provided that not all $R^1$ represent hydrogen, (B) cyclohexyldiethanolamine or methyl diethanolamine, (C) a 2-pyridylthio-1-oxide salt, and (D) optionally aliphatic carboxylic acids.

2. The water-soluble metalworking fluid according to claim 1, wherein components (A) and (B) are present in the water-soluble metalworking fluid, and wherein component (A) is present with a content of up to 50 mass % of the total amount of the water-based metalworking fluid, component (B) is present with a content of up to 50 mass % of the total amount of the water-based metalworking fluid and component (C) is present with a content of 0.01 to 5 mass % of the total amount of the water-based metalworking fluid.

3. The water-soluble metalworking fluid according to claim 1, wherein the water is present in the water-soluble metalworking fluid in an amount of 5 to 200 times as much as the amount of components (A), (B), and (C).

4. The water-soluble metalworking fluid according to claim 1, wherein the alkanolamine represented by formula (1) is at least one member selected from the group consisting of 1-amino-2-propanol, 2-amino-2-methyl-l-propanol and mixtures thereof.

5. The water-soluble metalworking fluid according to claim 1, wherein component (B) is cyclohexyldiethanolamine.

6. The water-soluble metalworking fluid according to claim 1, wherein the 2-pyridylthio-1-oxide salt is a member selected from the group consisting of 2-pyridylthio-1-oxide sodium, zinc bis(2-pyridylthio-1-oxide), bis(2-sulfidepyridine-1-olato) copper and mixtures thereof.

7. The water-soluble metalworking fluid according to claim 1, wherein the 2-pyridylthio-1-oxide salt is 2-pyridylthio-1-oxide sodium.

8. The water-soluble metalworking fluid according to claim 1, wherein the alkanolamine represented by formula (1) is selected from the group consisting of 1-amino-2-propanol, 2-amino-2-methyl-1-propanol and mixtures thereof, component (B) is cyclohexyldiethanolamine, and the 2-pyridylthio-1-oxide salt is 2-pyridylthio-1-oxide sodium.

9. The water-soluble metalworking fluid according to claim 1, wherein the alkanolamine represented by formula (1) is selected from the group consisting of 1-amino-2-propanol, 2-amino-2-methyl-1-propanol, 1-amino-2-butanol, 2-amino-1-propanol, 3-amino-2-butanol and mixtures thereof, component (B) is cyclohexyldiethanolamine, and the 2-pyridylthio-1 -oxide salt is selected from the group consisting of 2-pyridylthio-1-oxide sodium, zinc bis(2-pyridylthio-1-oxide), bis(2-sulfidepyridine-1-olato) copper and mixtures thereof.

10. The water-soluble metalworking fluid according to claim 1, wherein the alkanolamine represented by formula (1) is selected from the group consisting of 1-amino-2-propanol, 2-amino-2-methyl-1-propanol, 1-amino-2-butanol, 2-amino-1-propanol, 3-amino-2-butanol and mixtures thereof.

11. The water-soluble metalworking fluid according to claim 1, wherein component (A) is present in a content of 20 to 40 mass % of the total amount of the fluid, component (B) is present in a content of 20 to 40 mass % of the total amount of the fluid, and component (C) is present in a content of 0.05 to 1 mass % of the total amount of the fluid.

12. The water-soluble metalworking fluid according to claim 1, wherein components (A), (B), and (C) are present in an amount of at most 70% by weight of the total weight of the metalworking fluid, water is present in the water-soluble metalworking fluid in an amount of 5 to 200 times as much as the total amount of components (A), (B), and (C), by weight of the total weight of the metalworking fluid, and component (B) is cyclohexyldiethanolamine.

* * * * *